United States Patent [19]

Lodisio

[11] Patent Number: 4,807,557

[45] Date of Patent: Feb. 28, 1989

[54] SAFETY ALERT FOR WATER SKIERS

[76] Inventor: Richard A. Lodisio, P.O. Box 2284 - Cave Creek Stage, Cave Creek, Ariz. 85331

[21] Appl. No.: 96,853

[22] Filed: Sep. 14, 1987

[51] Int. Cl.[4] ..... G09F 17/00; G08B 5/02

[52] U.S. Cl. ..... 116/173; 116/28 R; 116/281

[58] Field of Search ..... 114/253, 254; 116/28 R, 116/173, 281, 283, 209; 248/519; 441/80, 89; 40/218, 601, 610

[56] References Cited

U.S. PATENT DOCUMENTS

| | | | |
|---|---|---|---|
| 2,936,541 | 5/1960 | Stanford | 116/281 |
| 3,602,188 | 8/1971 | Penaflor | 116/324 |
| 3,735,724 | 5/1973 | Miller | 116/303 |
| 3,786,778 | 1/1974 | Palmer et al. | 116/313 |
| 3,797,450 | 3/1974 | Frisbee | 116/28 R |
| 3,798,631 | 3/1974 | Langford | 340/279 |
| 3,904,887 | 9/1975 | Hagelbarger | 307/139 |
| 4,090,468 | 5/1978 | D'Spain | 116/313 |
| 4,122,796 | 10/1978 | Pressler et al. | 116/313 |

*Primary Examiner*—William A. Cuchlinski, Jr.
*Assistant Examiner*—W. Morris Worth
*Attorney, Agent, or Firm*—Richard R. Mybeck

[57] ABSTRACT

A safety alert for water skiers attachable to a tow boat and automatically actuated by a regulated release of tow line tension to elevate a flag to warn other boats that a skier is "down". An elastic member is operatively connected to a reciprocal flag standard and a tow line whereupon the memory of the elastic member elevates the flag into visible position when the tension on the tow line is released from the elastic member by the release of the skier therefrom. An intermediate member circumscribes a pull rope connected to the tow line and coacts with an obstructive member or knot disposed therein to regulate the actuation of the alert and prevent false messages from being transmitted thereby.

9 Claims, 1 Drawing Sheet

SAFETY ALERT FOR WATER SKIERS

INTRODUCTION

The present invention relates generally to the sport of water skiing and more particularly to a safety alert system for immediately raising a warning flag on a tow vessel in response to a fallen skier being towed thereby.

BACKGROUND OF THE INVENTION

The sport of water skiing has become extremely popular and is normally conducted by towing a person upon water skis. Generally a tow line affixed to the stern of the motor boat is grasped at an outer end thereof by a person upon water skis so as to be towed across the surface of a lake or the like. While this sport has gained wide spread acceptance, it is generally recognized that a number of substantial dangers are involved in the exercise thereof. Aside from the natural physical danger of falling or the like, the skier experiences further danger of possible injury by other boats cruising in the same area as the skier's activities. While there is relatively small likelihood of collision between a boat and a skier being towed upon the surface of the water, there is substantial danger of a fallen skier being run over by another motor boat whose pilot was unaware of the skier's presence in the water. This danger has led to the passage of laws requiring the presence of an observer in the stern of a ski boat towing a water skier. It has become common practice for the observer to signal the release of a tow line by a skier by the observer raising his arm.

In water skiing, it is inevitable that a majority of the skiers will eventually fall from their skis or be forced to release the tow line whereupon they will ultimately sink into the water. The presence of the skier in the water is not normally hazardous per se, either because the skier is a good swimmer or is wearing a floatation jacket. However, events do occur which place the skier in the precarious position of being relatively invisible to the operators of other boats in the area. A downed skier at or beneath the surface of the water is very difficult to observe by a motor boat operator particularly if the boat is being driven at a substantial speed which causes the bow of the boat to rise up from the water and obstruct the operator's view of the surface of the water immediately in front of the boat. This danger is particularly real in congested or crowded lakes and the like and substantial and numerous tragic accidents have occurred because of this sequence of events.

The problem of the fallen skier has been recognized over time and diverse attempts have been made to provide water skiers with automatic warning devices. For instance, there are several U.S. patents which show devices which are attachable to the body or head of a water skier for the purpose of raising a flag or the like when the skier falls. Certain limitations inherently arise from this general approach to the problem. For example, the height of any warning device that may be raised above a fallen skier is limited and the visibility of such warning devices can be seriously impaired when the skier is disposed in other than a vertical position in the water.

The present invention operates to provide a solution to this problem by automatically raising a warning flag on the tow boat immediately after the skier releases the tow line but regulated in a unique way to prevent false signals therefrom. In current practice, those operating tow boats have become particularly vigilant of other boats in its area, particularly looking for warning signals. The present invention, as will appear, takes particular advantages of this practice by providing a warning signal which appears upon the tow boat rather than upon the fallen skier.

Several devices and systems, as will hereinafter be described, have been proposed from time to time to automatically accomplish the observer's duties. By far, the most common technique relies solely on the observer. In many instances, observers are very conscientious and attentive to their duties. However, due to the relaxed nature, and partying that is sometimes associated with water activities, some observers are less attentive than they should be. Further, when an observer is holding the warning flag up, his usefulness in accomplishing other tasks, such as helping to pick up the fallen skier, is negated.

As mentioned above, several prior art devices and systems have been suggested to facilitate the use of a warning flag when a water skier goes down.

For example, U.S. Pat. Nos. 3,786,778; 4,090,468; and 4,122,796 all relate to flag raising mechanisms that are operated by the observer, or the boat's pilot, to raise and hold the warning flag in the up position when the skier goes down.

Another prior approach is shown in U.S. Pat. No. 3,798,631 which discloses an alarm system which is automatically triggered to produce an audio and/or visual warning when the skier goes down. When the audio alarm is produced, a warning flag must be placed into a special socket to shut off the audio alarm.

Others, such as U.S. Pat. Nos. 3,602,188 and 3,735,724, disclose a system for automatically raising a warning flag when the skier's weight on the tow line is released.

While each of the foregoing prior art devices accomplish, in varying degrees, the purpose of the present invention, they fall short of being totally satisfactory, or desirable, in a number of respects. Thus, the manually operated devices described in U.S. Pat. Nos. 3,786,778; 4,090,468; and 4,122,796, all rely on the attentiveness of the boat's observer, and can be only as reliable as the observer. The semi-automatic prior art device described in U.S. Pat. No. 3,798,631 and the fully automatic devices of U.S. Pat. Nos. 3,602,188 and 3,735,724 are all relatively complex and costly mechanisms and increase the risk of being rendered inoperative because of mechanical failure. Further, U.S. Pat. Nos. 3,602,188 and 3,735,724 are inherently capable of giving both false "positive" and false "negative" signals and in so doing, defeat the integrity of the warning system.

Therefore, a need still exists for a reliable and relatively simple safety alert device for use on boats which tow water skiers and it is toward fulfilling that need that the device of the present invention is directed.

BRIEF SUMMARY OF THE INVENTION

The present invention provides a elastic-biased flag standard having a flag disposed at a top thereof. The flag, when the skier is normally up and running, will be retracted into a hollow tube having an open top. The flag standard is connected by suitable means to a line which in turn engages the tow line for the water skier. The drag on the tow line provided by the skier being towed thereby creates sufficient tension to stretch the resilient member attached to the flag standard and draw the flag into a retracted position within the tube and maintain it in that position, invisible to those in the vicinity. However, when the skier being towed releases the tow line, either by fall or by choice, the tension applied to the tow line by the skier's drag is released whereupon the counterforce on the elastic bias is also released and the retraction of the elastic member to its normal position causes the standard to rise the warning flag to unfurl and be exposed on the boat. The reciprocal action of the flag standard within the housing is specially regulated to eliminate false alarms, thereby providing a reliable and positive warning to all other boats in the area that a water skier is truly down in the water in the vicinity of the boat carrying the alert.

Accordingly, it is an object of the present invention to provide a new and improved safety alert for water skiers for use on boats that are being employed to tow such water skiers.

Another object of the present invention is to provide a new and improved safety alert for water skiers which is adapted to be mounted on the transom of a tow boat without either substantially harming or defacing the boat or violating its structural integrity.

Another object of the present invention is to provide a new and improved safety alert for water skiers which is maintained in a flag down position while a water skier is being towed and is automatically and quickly moved to an exposed position when the skier falls or otherwise drops free of the boat by releasing the tow line thereto while avoiding false signals created by wave crests or the weight of start-up.

A still further object of the present invention is to provide a new and improved safety alert for water skiers which is inexpensive to manufacture, easy to install and reliable in operation.

These and still further objects as shall hereinafter appear are readily fulfilled by the present invention in a remarkably unexpected manner as will be readily discerned from the following detailed description of an exemplary embodiment thereof, especially when read in conjunction with the accompanying drawing in which like parts bear like numerals throughout the several views.

DESCRIPTION OF THE PREFERRED EMBODIMENTS

The present invention relates to a safety alert for use with tow boats to quickly provide a readily visible and notorious signal when the cargo towed thereby has broken free or otherwise become released. This invention is especially suited for providing a clearly discernible warning when a water skier towed behind a power driven tow boat has fallen or is otherwise loose in the water behind the boat and will be described in that setting.

Figure 1:
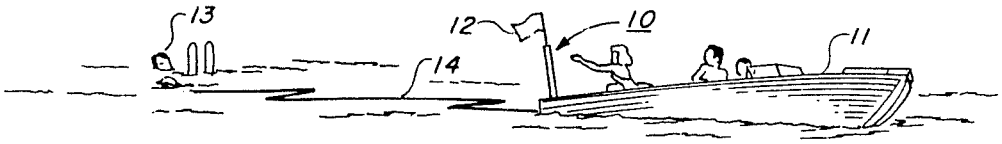
FIG. 1 is an isometric view of a device embodying the present invention in use with a tow boat.

As shown in FIG. 1, a device embodying the present invention, identified by the general reference 10, is secured to a boat 11 and reacts to display a warning flag 12 (preferably blaze orange) when the skier 13 towed thereby either falls or for other reasons releases tow rope 14 thereby slackening the tension placed therein while the skier was "up and running".

Figure 2:
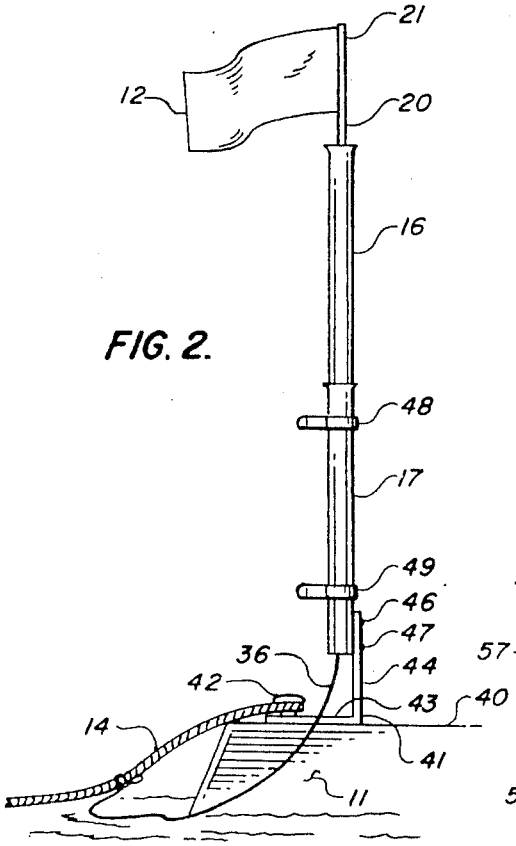
FIG. 2 is a side elevation of a safety alert device embodying the present invention.
Figure 4:
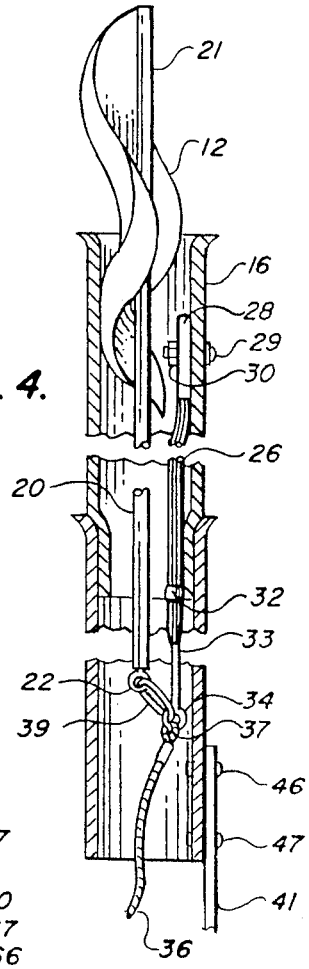
FIG. 4 is a partially fragmented cross-sectional view of the device of the present invention immediately after the tow rope has been released.

As shown in FIGS. 2 and 4, device 10 comprises a hollow upper tube 16 and a hollow lower tube 17, tube 16 being telescopically inserted into tube 17 to define an elongated hollow housing 18. An elongated flag standard 20 having a highly visible warning flag 12 attached thereto at the upper end 21 thereof is disposed within housing 18. A connector element 22 is secured to the lower end 23 of flag standard 20, preferably on the longitudinal axis thereof, for a purpose to be described later.

An elongated cylindraceous elastic member 26 is likewise disposed within hollow housing 18 and is secured at the upper end 27 thereof to upper tube member 16 on the inner surface thereof with a suitable cover plate 28 which is attached to tube member 16 with suitable securing means such as bolt 29 and nut 30. Bolt 29 is positioned so as to pass through tube member 16 and cover plate 28 in non-invasive relationship to elastic member 26.

Adjacent the distal end 31 of elastic member 26, clamping means 32 is circumscribed thereabout to secure extension member 33 thereto for axial extension therefrom. A suitable connector means 34 is provided at the distal end 35 of extension member 33 for cooperative interconnection with connector element 22 and a nylon pull rope 36. If desired, connector element 22 and connector means 34 can be combined into a single U-shaped member (not shown) connected by one arm to flag standard 20 and by its other arm to elastic member 26 with pull rope 36 wrapped therebetween.

Pull rope 36 extends downwardly from connector means 34 and connector element 22 for exit out of the opening 38 defined by tube member 17 for strategic connection to tow rope 14 outboard of boat 11.

In one embodiment of the present invention, as shown in FIG. 4, connector element 22 and connector means 34 each comprise an eyelet. Connector means 34 is connected to a loop 37 formed in pull rope 36. Connector element 22 and connector means 34 are joined by a hardened steel linking means 39.

Lower tube 17 is suitably secured to the rear deck 40 of tow boat 11 by an L-shaped support means 41 which is disposed adjacent cleat 42 which anchors tow rope 14 to boat 11. Support means 41 comprises a base plate 43 and a vertical plate 44 integrally formed therewith and extending upwardly therefrom in generally normal relationship thereto a distance sufficient to provide operative clearance between opening 38 and deck 40 for purposes which shall appear. Suitable bolts 46,47 are used to secure lower tube 17 to plate 44.

Upper and lower clamp members 48, 49 respectively are circumscribed about tube member 17 and extend outwardly therefrom is spaced generally parallel registered relationship with each other to receive upper tube 16 therewithin for storage when device 10 is not in use.

Figure 5:
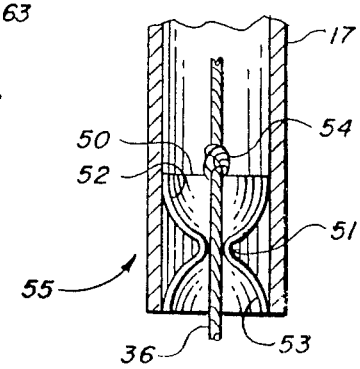
FIG. 5 is a fragmented cross-sectional view of a regulator means embodying the present invention.

In one embodiment of the present invention as shown in FIG. 5, an hourglass-shaped member 50 is mounted within lower tube 17 just above the lower opening thereof and provides a constricted aperture on throat 51 therein for a purpose to be described. Each member 50 comprises an inwardly converging upper portion 52 and an outwardly diverging lower portion 53 through which pull rope 36 is fed between linking means 39 and tow rope 14.

In connection therewith a knot 54 is tied in pull rope 36 just above aperture 51 when rope 36 hangs freely therethrough and is arranged to have a diameter which is 1/16 to ⅛ inch larger than the diameter of throat 51 to provide regulator means 55 to the actuation of safety alert 10 thereby preventing false signals from being transmitted such as when a temporary slackening of the tension in tow rope 14 occurs as a skier rides down a wave which otherwise would raise the flag, or the initial tension created as the skier attempts to rise but is not yet up which otherwise would lower the flags prematurely. It is believed that the dimensional difference between knot 54 and throat 51 is sufficient to allow a differential of about 40 psi to be absorbed before knot 54 passes through throat 51 and allows the device to respond and signal the true situation.

In an alternative embodiment, aperture or throat 51 can be provided by a disc member (not shown) mounted transversely within tube 17.

Figure 6:
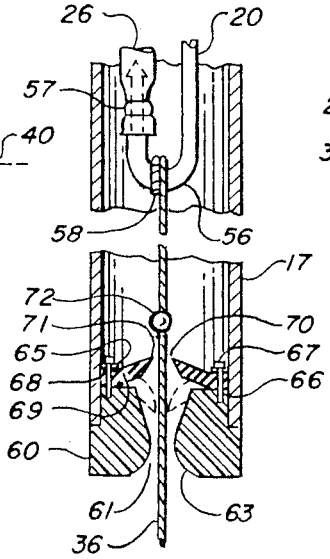
FIG. 6 is a fragmented cross-sectional view of another regulator means embodying the present invention.

In still another embodiment of the present invention as shown in FIG. 6, flag standard 20 is provided with a U-shaped lower portion 56 which extends upwardly therefrom for telescopic engagement within elastic member 26 to which it is secured by a suitable retaining clip 57. In this embodiment, pull rope 36 is secured around the lower arc portion 58 and depends downwardly therefrom through regulator means disposed in lower tube 17 and out through the lower opening as described before.

A special embodiment of regulator means 55 is shown in FIG. 6 and comprises a molded plastic end cap 60 having a generally convergent passageway 61 defined therethrough between its planar annular upper surface and its beveled lower surface 63.

An annular elastomeric clutch member is disposed upon surface 62 and secured thereto by the placement of annular retaining ring 65 thereupon which is secured thereto by a plurality of bolts 66 embedded in end cap 60 and extending upwardly therefrom for passage through retaining ring 65 for secured engagement by suitable nuts 67.

Clutch member, as shown in FIG. 6, comprises an annular perimeter portion 68 and an inwardly and upwardly converging central portion 69 having an opening or throat 70 defined therethrough by leading edge 71 and responsive to a spherical clutch piston 72 which is secured about pull rope 36 as an alternative for knot 54 and coactive with the flexure of clutch member into passageway 61 to create the constrictive throat 51, previously described, and regulate the passage of piston 72 therethrough and deter the transmittal of a false alarm thereby.

In one practice of the present invention, device 10 is attached to boat 11 by support means 41. Upper tube 16 is inserted into tube 17 so that pull rope 36 depends therefrom for attachment to tow rope 14 at a position which allows flag standard 20 to fully extend when tow rope 14 is in a slackened state and to stretch elastic member 26 a sufficient distance to totally draw flag standard 20 into housing 18 and obstruct flag 12 from view when a water skier 13 is towed by boat 11. With tow rope 14 under tension, warning flag 12 is encased within housing 18 in response to the descending linking means 39 reacting within the force-applied elongation of elastic member 26. Flag 12 remains hidden from view within housing 18 for so long as skier 13 is up and going. Should skier 13 fall or otherwise release tow rope 14, member 26 will immediately retract pulling linking mean 39 and hence flag standard 20 in an upwardly direction until warning flag 12 is displayed in full view. Regulator means 55 when operatively secured within tube 17 as shown in FIG. 5 and FIG. 6, will prevent "false" alarms by requiring a preselected pull on pull rope 36 to occur before knot 54 or spherical clutch piston 72 passes through throat 51 which serves as a condition precedent to the free response of device 10 as described above.

Figure 3:
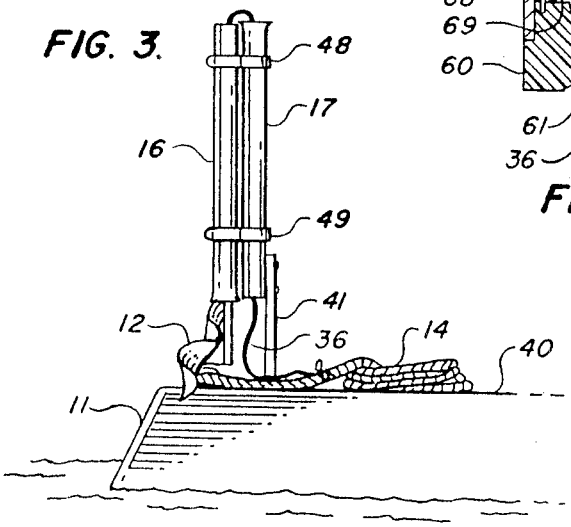
FIG. 3 is a side elevation of the device of FIG. 2 in a stored position.

When device 10 is not in use, upper tube 16 is withdrawn from tube 17 and "folded over" into engagement into clamp 48,49 with flag 12 depending therefrom on to deck 40 while pull rope 36, still secured to tow rope 14, is coiled on deck 40 as shown in FIG. 3.

While a number of suitable materials may be used to form tubes 16, 17 and base plate 43, special attention should be paid to the strength required and whether device 10 is to be used with fresh or salt water. Stainless steel has been found to be a satisfactory material for these members.

Elastic member 26 is preferably formed of medical grade silastic material which has great tensile strength and elastic memory and totally avoids the mechanical failure and fouled lines which inevitably accompanied the coil springs heretofore used in such devices. Regulator means 55 is preferably formed of a corrosion resistant strong plastic material such as polyvinyl chloride or the like although a polished stainless steel and the like can be used when cost is not a factor.

From the foregoing, it is apparent that an invention has been herein described and illustrated which fulfills all of the aforestated objectives in a remarkably unexpected fashion. It is of course understood that such modifications, alterations and adaptations as may readily occur to the artisan confronted with this disclosure are intended within the spirit of this disclosure which is limited only by the scope of the claims appended hereto.

Accordingly, what is claimed is:

1. A flag safety alert for water skiers comprising an open ended flag housing adapted to be mounted to the deck of a tow boat; an elongated flag standard having a flag attached to one end thereof and connector means attached to the other end thereof; a cylindraceous elastic member having elastic memory and operatively secured at one end thereof to said flag housing and having an extension member secured to the distal end thereof and extending axially therefrom; a pull rope extending axially in said housing and simultaneously secured to said connector means and said extension means at one end thereof and having a distal end attachable to a skier tow line whereby said pull rope when receiving tension from said tow line is operative to simultaneously elongate said elastic member and draw said flat standard axially into a non-visible position within said flag housing and when receiving no tension from said tow line ridges upwardly into said flag housing in response to said elastic memory of said elastic member which elevates said flag standard into a visible position, said pull rope having an obstruction defined thereon having a first diameter, said housing having a constricted throat defined therein adjacent the lower end thereof and having a second diameter smaller than said first diameter, said throat being adapted to pass said obstruction therethrough only in response to a preselected pressure applied to said pull rope from the other side of said throat thereby providing a regulator means.

2. A flag safety alert according to claim 1 in which said open ended flag housing comprises an upper tube and a lower tube, said upper tube being telescopically insertable within said lower tube to create said housing.

3. A flag safety alert according to claim 1 in which said throat is defined within an hourglass-shaped member secured within said housing.

4. A flag safety alert according to claim 1 in which said elastic member is formed of elastic silicone rubber.

5. A flag safety alert according to claim 1 in which said obstruction is defined by a knot strategically tied in said pull rope.

6. A flag safety alert according to claim 1 in which said regulator means is operatively interposed between said tow line and said elastic member to eliminate the transmission of false alarms therebetween.

7. A flag safety alert according to claim 6 in which said regulator means comprises an end cap telescopically inserted into the lower end of said lower tube, an annular clutch member secured to said end cap and pivotal relative thereto to define a throat means therewith, an obstruction means secured to said pull rope adjacent said throat for passage through said throat in response to a preselected pull on said pull rope.

8. A flag alert according to claim 7 in which said preselected pull is produced by said tow rope.

9. A flag alert according to claim 7 in which said preselected pull is produced by said elastic member.

* * * * *